US011276341B2

(12) United States Patent
Kim et al.

(10) Patent No.: US 11,276,341 B2
(45) Date of Patent: Mar. 15, 2022

(54) DISPLAY DRIVING APPARATUS

(71) Applicant: Silicon Works Co., Ltd., Daejeon (KR)

(72) Inventors: Young Bok Kim, Daejeon (KR); Taiming Piao, Daejeon (KR)

(73) Assignee: Silicon Works Co., Ltd, Daejeon (KR)

( * ) Notice: Subject to any disclaimer, the term of this patent is extended or adjusted under 35 U.S.C. 154(b) by 0 days.

(21) Appl. No.: 17/083,560

(22) Filed: Oct. 29, 2020

(65) Prior Publication Data

US 2021/0125537 A1 Apr. 29, 2021

(30) Foreign Application Priority Data

Oct. 29, 2019 (KR) ..... 10-2019-0135476

(51) Int. Cl.
*G09G 3/20* (2006.01)

(52) U.S. Cl.
CPC ..... *G09G 3/20* (2013.01); *G09G 2310/0291* (2013.01)

(58) Field of Classification Search
CPC combination set(s) only.
See application file for complete search history.

(56) References Cited

U.S. PATENT DOCUMENTS

2008/0079706 A1* 4/2008 Chia ..... G06F 1/3203 345/211
2015/0049483 A1* 2/2015 Lee ..... G09F 13/22 362/235

FOREIGN PATENT DOCUMENTS

KR 20090068342 A 6/2009
KR 20160037010 A 4/2016
KR 20160077252 A 7/2016
KR 20180031314 A 3/2018

* cited by examiner

*Primary Examiner* — Van N Chow
(74) *Attorney, Agent, or Firm* — Polsinelli PC

(57) ABSTRACT

A display driving apparatus includes a first bias circuit configured to provide a first bias current; a second bias circuit configured to provide a second bias current; a selection circuit configured to select and output the first bias current as a bias current during a first period in which a change in a driving current occurs, and select and output the second bias current as the bias current during a second period from after the first period to until a next change in the driving current occurs; and an output buffer configured to drive a first input current or a second input current by the bias current, and output the driving current for driving a panel, in correspondence to the first input current or the second input current.

14 Claims, 3 Drawing Sheets

DISPLAY DRIVING APPARATUS

FIELD OF INVENTION

This application claims priority to Korean Application No. KR 10-2019-0135476, filed Oct. 29, 2019, which is incorporated by reference herein in its entirety.

BACKGROUND

1. Technical Field

Various embodiments generally relate to a display driving apparatus, and more particularly, to a display driving apparatus which is improved to be able to quickly drive a panel.

2. Related Art

In general, a display device is configured to receive display data and provide a driving current corresponding to the display data to a panel in order to display an image.

The display device is designed to drive the panel at high speed in order to realize high image quality.

In order to drive the panel at high speed, the slew rate of the driving current needs to be improved. To improve the slew rate, a bias current having a high level should be provided to an output buffer.

Therefore, in the general display device, such a bias current having a high level is provided to all channels regardless of whether the driving current is generated or not. Therefore, a problem may be caused in that a total current consumption amount of the display device increases.

SUMMARY

Various embodiments are directed to a display driving apparatus which can output a driving current using a high bias current during a period in which the driving current is changed and output the driving current using a low bias current during the other period, thereby reducing a total current consumption amount required to supply the driving current to a panel.

Also, various embodiments are directed to a display driving apparatus which can monitor in real time the current flow of an output terminal of an output buffer for each channel and provide, to the output buffer, a high bias current during a period in which a driving current is generated and changed, thereby supplying the driving current with an improved slew rate and reducing a total current consumption amount.

In an embodiment, a display driving apparatus may include: a first bias circuit configured to provide a first bias current; a second bias circuit configured to provide a second bias current; a selection circuit configured to select and output the first bias current as a bias current during a first period in which a change in a driving current occurs, and select and output the second bias current as the bias current during a second period from after the first period to until a next change in the driving current occurs; and an output buffer configured to drive a first input current or a second input current by the bias current, and output the driving current for driving a panel, in correspondence to the first input current or the second input current, wherein the first bias current has a level higher than the second bias current.

In an embodiment, a display driving apparatus may include: a bias current source configured to provide a first bias current and a second bias current, the first bias current being higher than the second bias current; a selection circuit configured to receive the first bias current and the second bias current, and, by a monitoring signal, select and output the first bias current as a bias current during a first period and select and output the second bias current as the bias current during a second period; an output circuit configured to drive a first input current or a second input current by the bias current, and output a driving current for driving a panel, in correspondence to the first input current or the second input current; and a monitoring circuit configured to monitor the driving current, and provide the monitoring signal distinguishing the first period in which a change in the driving current occurs and the second period from after the first period to until a next change in the driving current occurs.

According to the embodiments of the disclosure, an advantage is provided in that the slew rate of a driving current may be improved by using a high bias current during a period in which a change in the driving current occurs.

Also, according to the embodiments of the disclosure, an advantage is provided in that, by using a high bias current during a period in which a change in the driving current occurs and using a bias current having a low level during the other period, a total current consumption amount required to supply the driving current may be reduced.

Further, according to the embodiments of the disclosure, by monitoring, in real time, the current flow of an output terminal of an output buffer for each channel and providing a high bias current to the output buffer during a period in which the driving current is changed, it is possible to supply the driving current with an improved slew rate. Therefore, an advantage is provided in that a total current consumption amount of a display driving apparatus may be reduced.

DETAILED DESCRIPTION

An embodiment of the disclosure is configured to provide a high bias current during a period in which a change in a driving current occurs and provide a relatively low bias current during the other period.

Figure 1:
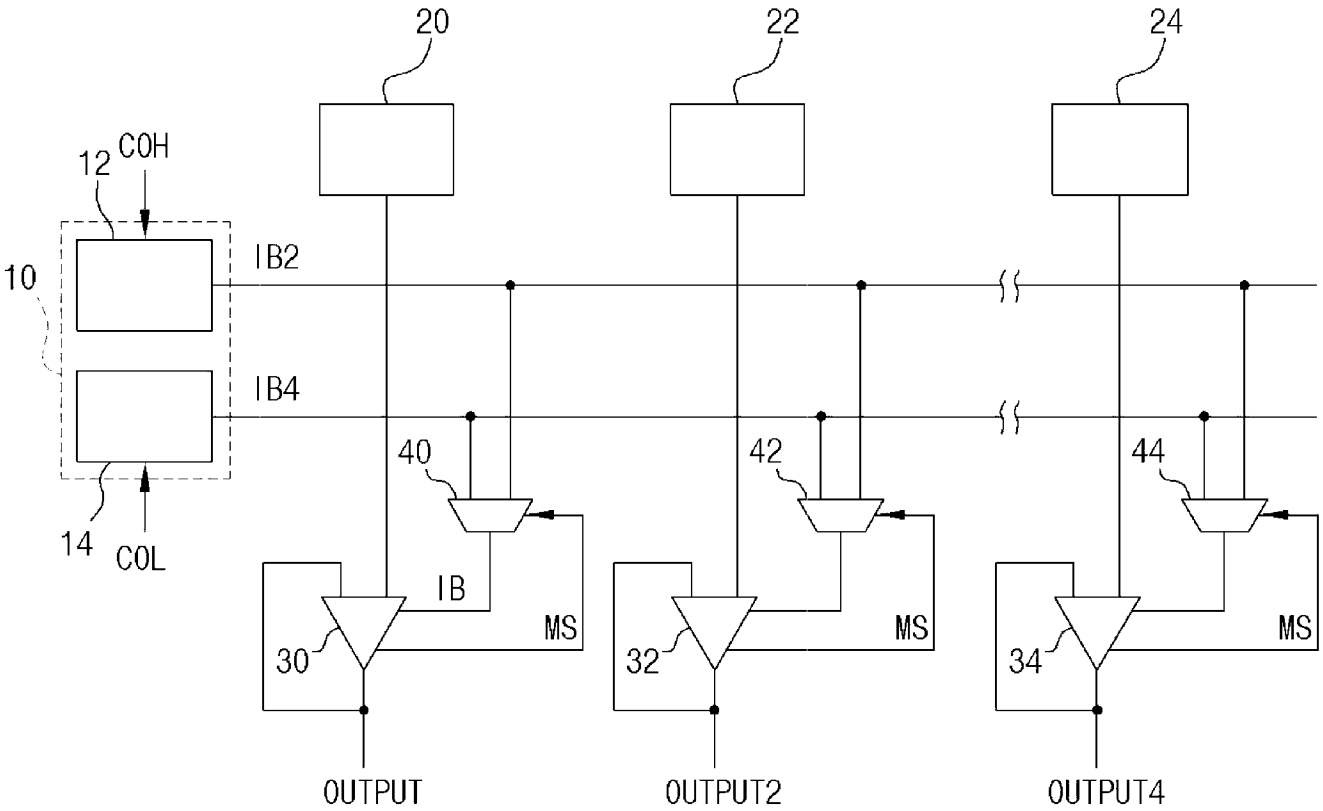
FIG. 1 is a block diagram illustrating a display driving apparatus in accordance with an embodiment of the disclosure.

As illustrated in FIG. 1, the embodiment includes a bias current source 10, digital-analog converters 20, 22 and 24, output buffers 30, 32 and 34, and selection circuits 40, 42 and 44.

A display driving apparatus outputs driving signals for driving a panel, through a plurality of channels. In order to represent this, the embodiment is exemplified as outputting driving currents OUTPUT, OUTPUT2 and OUTPUT4 through a plurality of channels as illustrated in FIG. 1. In FIG. 1, each of the driving currents OUTPUT, OUTPUT2 and OUTPUT4 has a level for representing a gray scale corresponding to display data of a corresponding channel.

The embodiment of the display driving apparatus provides a bias current in common to the respective channels, and is configured such that one digital-analog converter, one output buffer and one selection circuit correspond to each channel.

Figure 2:
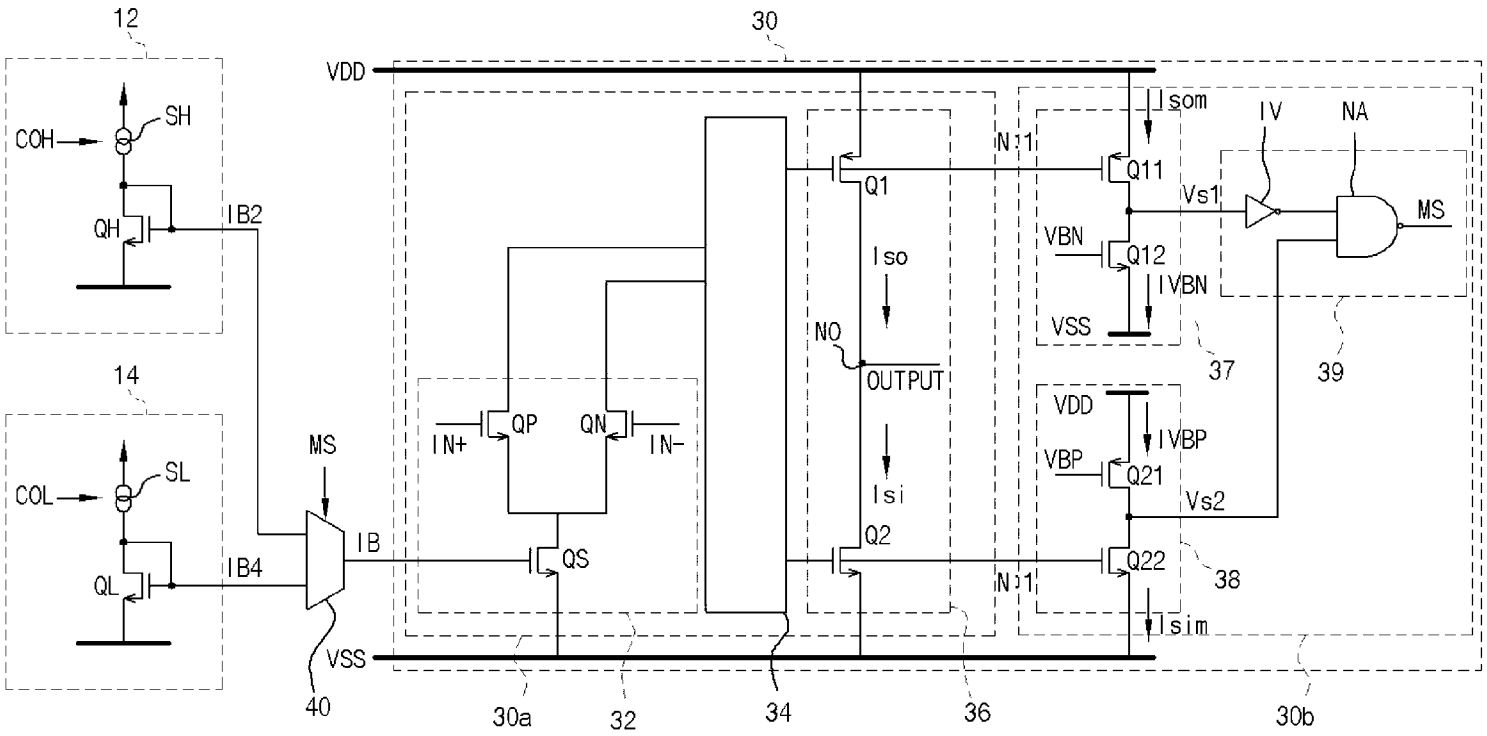
FIG. 2 is a detailed circuit diagram for one channel which outputs a driving current.

For the sake of convenience in explanation, the configuration and operation of the embodiment of the disclosure will be described representatively based on one channel including the digital-analog converter 20, the output buffer 30 and the selection circuit 40. FIG. 2 is a detailed circuit diagram for one channel in which the digital-analog converter 20, the output buffer 30 and the selection circuit 40 of FIG. 1 are included. Since the configurations and operations of the other channels may be understood with reference to FIGS. 1 and 2, repeated description will be omitted.

Hereinafter, the configuration and operation of the embodiment of the disclosure will be described with reference to FIGS. 1 and 2.

The bias current source 10 includes a first bias circuit 12 and a second bias circuit 14, and provides a first bias current IB2 and a second bias current IB4 to each channel.

The first bias circuit 12 receives a current option COH for outputting a current of a relatively high level, and outputs the first bias current IB2 higher than the second bias current IB4.

To this end, the first bias circuit 12 includes a current source SH and a driving transistor QH which are connected in series. The current source SH may be constituted by various parts each of which provides a constant current having a level corresponding to the current option COH. The driving transistor QH may be constituted by an NMOS transistor, and is configured to output the current of the current source SH corresponding to the current option COH, that is, the first bias current IB2, as a drain and a gate thereof are connected to the current source SH.

The second bias circuit 14 receives a current option COL for outputting a current of a level lower than the first bias current IB2, and outputs the second bias current IB4 lower than the first bias current IB2.

To this end, the second bias circuit 14 includes a current source SL and a driving transistor QL which are connected in series. The current source SL may be constituted by various parts each of which provides a constant current having a level corresponding to the current option COL. The driving transistor QL may be constituted by an NMOS transistor, and is configured to output the current of the current source SL corresponding to the current option COL, that is, the second bias current IB4, as a drain and a gate thereof are connected to the current source SL.

The digital-analog converter 20 is configured to provide a current of a gray scale corresponding to display data, to the output buffer 30.

The output buffer 30 receives a first input current IN+ and a second input current IN−. The first input current IN+ is provided from the digital-analog converter 20, and the second input current IN− is a feedback of the driving current OUTPUT which is outputted from the output buffer 30.

The output buffer 30 is configured to drive the first input current IN+ and the second input current IN− by a bias current IB provided from the selection circuit 40, and output the driving current OUTPUT for driving the panel (not illustrated) in correspondence to the first input current IN+ and the second input current IN−.

Further, the output buffer 30 is configured to monitor sourcing and sinking for the output of the driving current OUTPUT, and provide a monitoring signal MS having a value that distinguishes a first period P1 in which a sourcing current Iso and a sinking current Isi for the output of the driving current OUTPUT are generated and a second period P2 following the first period P1.

The first period P1 is a period in which the driving current OUTPUT changes from a low level to a high level or changes from a high level to a low level, and the second period P2 is a period in which the driving current OUTPUT maintains a low level or maintains a high level. That is to say, the first period P1 is a period in which a change in the driving current OUTPUT occurs, and the second period P2 is a period from after the first period P1 to until a next change in the driving current OUTPUT occurs.

In detail, the output buffer 30 is configured to compare the sourcing current Iso with a first reference current by a preset sourcing reference voltage VBN, compare the sinking current Isi with a second reference current by a preset sinking reference voltage VBP, and provide the monitoring signal MS distinguishing, as the first period P1, a period in which the sourcing current Iso is higher than the first reference current or the sinking current Isi is higher than the second reference current. This may be understood with reference to the configuration and operation of a monitoring circuit 30*b* which will be described later.

The selection circuit 40 is configured to output the first bias current IB2 as the bias current IB during the first period P1 in which a change in the driving current OUTPUT occurs, and output the second bias current IB4 as the bias current IB during the second period P2 from after the first period P1 to until a next change in the driving current OUTPUT occurs.

The selection circuit 40 may include a multiplexer which receives the first bias current IB2, the second bias current IB4 and the monitoring signal MS and outputs the bias current IB.

The selection circuit 40 is configured to select, by the monitoring signal MS, to output the first bias current IB2 or the second bias current IB4 as the bias current IB. As described above, the monitoring signal MS may be understood as a control signal which selects one of the first bias current IB2 and the second bias current IB4 depending on a value thereof.

Among the above-described components, the configuration of the output buffer 30 will be described below in detail.

The output buffer 30 includes an output circuit 30*a* and the monitoring circuit 30*b*.

The output circuit 30*a* is configured to drive the first input current IN+ and the second input current IN− by the bias current IB, and output the driving current OUTPUT by alternately performing sourcing by a first constant voltage VDD and sinking by a second constant voltage VSS in correspondence to the first input current IN+ and the second input current IN−.

To this end, the output circuit 30*a* includes an input stage circuit 32, a load stage circuit 34 and an output stage circuit 36.

The input stage circuit 32 is configured to drive the first input current IN+ and the second input current IN− by the bias current IB provided from the selection circuit 40.

The input stage circuit 32 includes an NMOS transistor QS having a gate to which the bias current IB is inputted, an NMOS transistor QP having a gate to which the first input current IN+ is inputted, and an NMOS transistor QN having a gate to which the second input current IN− is inputted. Sources of the NMOS transistor QP and the NMOS transistor QN are connected in common to a drain of the NMOS transistor QS. Drains of the NMOS transistor QP and the NMOS transistor QN are connected to the load stage circuit 34 to transfer the first input current IN+ and the second input current IN−.

By the above configuration, levels of the first input current IN+ and the second input current IN− provided to the load stage circuit 34 may be determined by the bias current IB applied to the gate of the NMOS transistor QS.

In the case where the bias current IB is the first bias current IB2 which has a relatively high level, the NMOS transistor QS may ensure a relatively large amount of current flow, and accordingly, the first input current IN+ and the second input current IN− provided to the load stage circuit 34 may have relatively high levels.

Conversely, in the case where the bias current IB is the second bias current IB4 which has a relatively low level, the NMOS transistor QS may ensure a relatively small amount of current flow, and accordingly, the first input current IN+ and the second input current IN− provided to the load stage circuit 34 may have relatively low levels.

The load stage circuit 34 is configured to output a high driving voltage and a low driving voltage in correspondence to the first input current IN+ and the second input current IN−.

The output stage circuit 36 is configured to output the driving current OUTPUT by alternately performing the sourcing according to the first constant voltage VDD corresponding to the high driving voltage of the load stage circuit 34 and the sinking according to the second constant voltage VSS corresponding to the low driving voltage of the load stage circuit 34 in correspondence to the first input current IN+ and the second input current IN−.

To this end, the output stage circuit 36 includes a PMOS transistor Q1 and an NMOS transistor Q2.

The PMOS transistor Q1 and the NMOS transistor Q2 are connected in series such that drains thereof are connected to each other to form an output node NO. The first constant voltage VDD is applied to a source of the PMOS transistor Q1, and the second constant voltage VSS is applied to a source of the NMOS transistor Q2. The high driving voltage of the load stage circuit 34 is applied to a gate of the PMOS transistor Q1, and the low driving voltage of the load stage circuit 34 is applied to a gate of the NMOS transistor Q2. The first constant voltage VDD may be understood as an operating voltage for an analog operation, and the second constant voltage VSS may be understood as a ground voltage for an analog operation.

If the high driving voltage is outputted at a level capable of turning on the PMOS transistor Q1, in the output stage circuit 36, the PMOS transistor Q1 is turned on, and the sourcing is started. The sourcing current Iso flows through the PMOS transistor Q1 according to a potential difference between the first constant voltage VDD and the output node NO.

If the low driving voltage is outputted at a level capable of turning on the NMOS transistor Q2, in the output stage circuit 36, the NMOS transistor Q2 is turned on, and the sinking is started. The sinking current Isi flows through the NMOS transistor Q2 according to a potential difference between the second constant voltage VSS and the output node NO.

Figure 3:
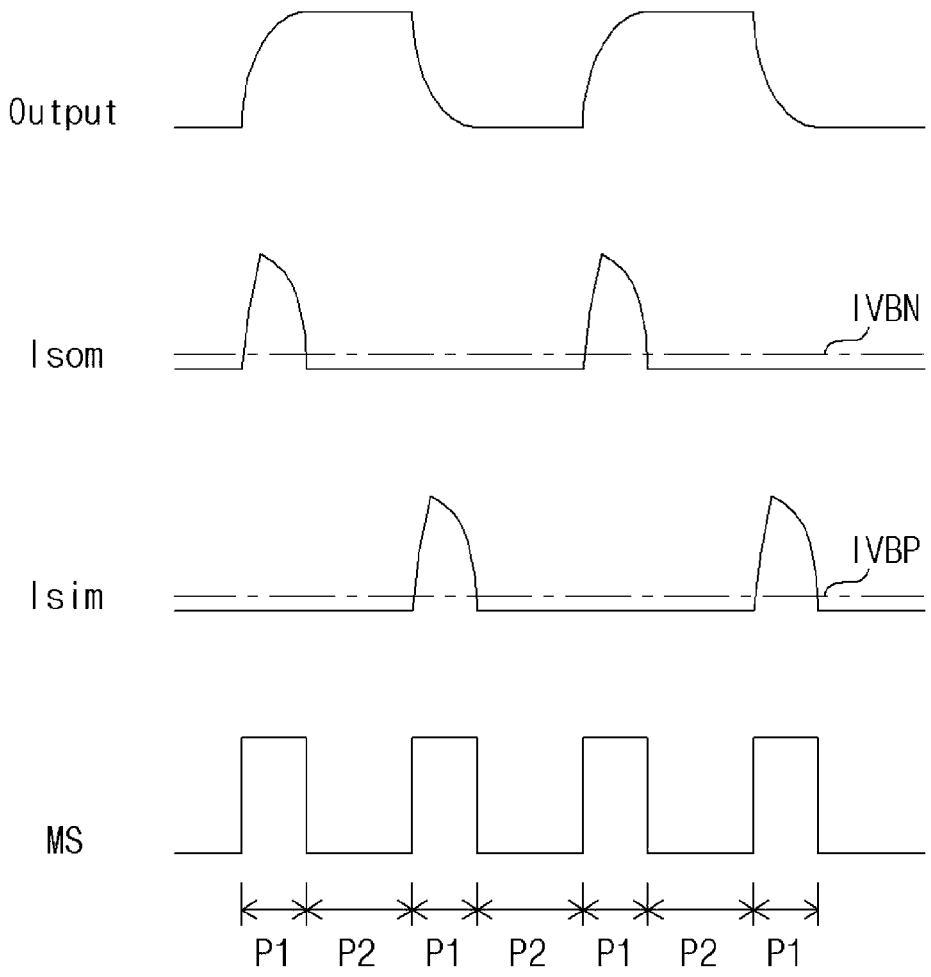
FIG. 3 is a waveform diagram to assist in the explanation of an operation of the embodiment of the disclosure.

The driving current OUTPUT outputted from the output node NO is illustrated in FIG. 3. The driving current OUTPUT is outputted to have a waveform in which a high level and a low level are repeated.

The monitoring circuit 30*b* is configured to provide the monitoring signal MS having a value that distinguishes the first period P1 and the second period P2, by monitoring the sourcing current Iso by the sourcing and the sinking current Isi by the sinking. The monitoring signal MS may be understood with reference to FIG. 3, and has a waveform that toggles between a high level and a low level as the first period P1 and the second period P2 are repeated. The first period P1 corresponds to a high level, and the second period P2 corresponds to a low level.

To this end, the monitoring circuit 30*b* includes a first sensing unit 37, a second sensing unit 38 and a monitoring output unit 39.

The first sensing unit 37 is configured to compare the sourcing current Iso with the first reference current by the preset sourcing reference voltage VBN, and output a first sensing voltage Vs1 obtained by determining a period in which the sourcing current Iso is higher than the first reference current.

The first sensing unit 37 includes a PMOS transistor Q11 and an NMOS transistor Q12 which are connected in series.

The PMOS transistor Q11 and the NMOS transistor Q12 are configured to have drains which are connected to each other, and the first sensing voltage Vs1 may be outputted through a common drain.

The PMOS transistor Q11 is configured such that the first constant voltage VDD is applied to a source and the high driving voltage of the load stage circuit 34 is applied to a gate. The NMOS transistor Q12 is configured such that the second constant voltage VSS is applied to a source and the sourcing reference voltage VBN is applied to a gate. The sourcing reference voltage VBN is set as a constant voltage as in FIG. 3. A current flowing through the PMOS transistor Q11 may be understood as a first sensing current Isom, and a current flowing through the NMOS transistor Q12 may be understood as a first reference current IVBN.

The PMOS transistor Q11 is configured to share the high driving voltage of the gate with the PMOS transistor Q1 of the output stage circuit 36. The PMOS transistor Q11 and the PMOS transistor Q1 are configured to have current driving capabilities of 1:N. N may be a natural number or a positive real number.

In other words, the PMOS transistor Q11 of the first sensing unit 37 and the PMOS transistor Q1 may be understood as having a current mirror structure which induces the flow of the first sensing current Isom proportional to the sourcing current Iso. Therefore, the fact that the first sensing unit 37 compares the sourcing current Iso with the first reference current by the preset sourcing reference voltage VBN may be understood as corresponding to the comparison of the first sensing current Isom of the PMOS transistor Q11 and the first reference current IVBN of the NMOS transistor Q12.

The first sensing unit 37 outputs the first sensing voltage Vs1 corresponding to a difference between the first sensing current Isom of the PMOS transistor Q11 corresponding to the sourcing and the first reference current IVBN of the NMOS transistor Q12 corresponding to the sourcing reference voltage VBN.

The second sensing unit 38 is configured to compare the sinking current Isi with the second reference current by the preset sinking reference voltage VBP, and output a second sensing voltage Vs2 obtained by determining a period in which the sinking current Isi is higher than the second reference current.

The second sensing unit 38 includes a PMOS transistor Q21 and an NMOS transistor Q22 which are connected in series.

The PMOS transistor Q21 and the NMOS transistor Q22 are configured to have drains which are connected to each other, and the second sensing voltage Vs2 may be outputted through a common drain.

The PMOS transistor Q21 is configured such that the first constant voltage VDD is applied to a source and the sinking reference voltage VBP is applied to a gate. The NMOS transistor Q22 is configured such that the second constant voltage VSS is applied to a source and the low driving voltage of the load stage circuit 34 is applied to a gate. The sinking reference voltage VBP is set as a constant voltage as in FIG. 3. A current flowing through the PMOS transistor Q21 may be understood as a second reference current IVBP, and a current flowing through the NMOS transistor Q22 may be understood as a second sensing current Isim.

The NMOS transistor Q22 is configured to share the low driving voltage of the gate with the NMOS transistor Q2 of the output stage circuit 36. The NMOS transistor Q22 and the NMOS transistor Q2 are configured to have current driving capabilities of 1:N.

In other words, the NMOS transistor Q22 of the second sensing unit 38 and the NMOS transistor Q2 may be understood as have a current mirror structure which induces the flow of the second sensing current Isim proportional to the sinking current Isi. Therefore, the fact that the second sensing unit 38 compares the sinking current Isi with the second reference current by the preset sinking reference voltage VBP may be understood as corresponding to the comparison of the second sensing current Isim of the NMOS transistor Q22 and the second reference current IVBP of the PMOS transistor Q21.

The second sensing unit 38 outputs the second sensing voltage Vs2 corresponding to a difference between the second sensing current Isim of the NMOS transistor Q22 corresponding to the sinking and the second reference current IVBP of the PMOS transistor Q21 corresponding to the sinking reference voltage VBP.

FIG. 3 illustrates a relationship between the first sensing current Isom and the first reference current IVBN by the sourcing reference voltage VBN and a relationship between the second sensing current Isim and the second reference current IVBP by the sinking reference voltage VBP.

In the configuration of the monitoring circuit 30*b* as described above, in the case where the driving current OUTPUT changes from a low level to a high level, the sourcing current Iso is temporarily generated higher than the first reference current IVBN. In addition, in the case where the driving current OUTPUT changes from a high level to a low level, the sinking current Isi is temporarily generated higher than the second reference current IVBP.

The embodiment of the disclosure drives the input currents IN+ and IN− by using the first bias current IB2 having a relatively high level as the bias current IB during the first period P1, for the sourcing current Iso and the sinking current Isi which temporarily increase.

Since the sourcing reference voltage VBN as the constant voltage is applied to the gate of the NMOS transistor Q12, the first reference current IVBN flowing through the NMOS transistor Q12 of the first sensing unit 37 maintains a constant level. Also, since the sinking reference voltage VBP as the constant voltage is applied to the gate of the PMOS transistor Q21, the second reference current IVBP flowing through the PMOS transistor Q21 of the second sensing unit 38 maintains a constant level.

If the driving current OUTPUT changes from a low level to a high level, the level of the sourcing current Iso temporarily sharply increases as described above. Accordingly, the first sensing current Isom flowing through the PMOS transistor Q11 of the first sensing unit 37 temporarily sharply increases according to the change in the sourcing current Iso. At this time, the first sensing current Isom has a level higher than the first reference current IVBN, and the first sensing unit 37 outputs the first sensing voltage Vs1 of a high level.

If the driving current OUTPUT changes from a high level to a low level, the level of the sinking current Isi temporarily sharply increases as described above. Accordingly, the second sensing current Isim flowing through the NMOS transistor Q22 of the second sensing unit 38 may be generated at a high level according to the change in the sinking current Isi. At this time, the second sensing current Isim has a level higher than the second reference current IVBP, and the second sensing unit 38 outputs the second sensing voltage Vs2 of a low level.

If the driving current OUTPUT maintains a high level or maintains a low level without sharply increasing or decreasing, the sourcing current Iso and the sinking current Isi maintain low levels. Therefore, the first sensing current Isom of the first sensing unit 37 maintains a level lower than the first reference current IVBN, and the second sensing current Isim of the second sensing unit 38 maintains a level lower than the second reference current IVBP. At this time, the first sensing voltage Vs1 of the first sensing unit 37 has a low level, and the second sensing voltage Vs2 of the second sensing unit 38 has a high level.

The monitoring output unit 39 provides the monitoring signal MS having a value that distinguishes the first period P1 and the second period P2, by monitoring the sourcing current Iso by the sourcing and the sinking current Isi by the sinking.

In detail, the monitoring output unit 39 receives and combines the first sensing voltage Vs1 of the first sensing unit 37 and the second sensing voltage Vs2 of the second sensing unit 38.

The monitoring output unit 39 is configured to, as a result of the combination, provide the monitoring signal MS corresponding to the first period P1 in the case where the sourcing current Iso is higher than the first reference current IVBN or the sinking current Isi is higher than the second reference current IVBP or provide the monitoring signal MS corresponding to the second period P2 in the case where the sourcing current Iso is equal to or lower than the first reference current IVBN and the sinking current Isi is equal to or lower than the second reference current IVBP. FIG. 3 illustrates that the monitoring signal MS has a high level during the first period P1 and has a low level during the second period P2.

To this end, the monitoring output unit 39 is configured to include an inverter IV and a NAND gate NA.

The inverter IV inverts the polarity of the first sensing voltage Vs1, and the NAND gate NA outputs a result of performing a NAND operation on the output of the inverter IV and the second sensing voltage Vs2, as the monitoring signal MS.

In the case of the sourcing in which the driving current OUTPUT changes from a low level to a high level, the sourcing current Iso is generated as in FIG. 3. Accordingly, the first sensing unit 37 outputs the first sensing voltage Vs1 of a high level. At this time, since the sinking current Isi is generated at a low level, the second sensing unit 38 outputs the second sensing voltage Vs2 of a high level. The inverter IV receives the first sensing voltage Vs1 of a high level and converts it into a low level. The NAND gate NA receives the output of the inverter IV which has a low level and the second sensing voltage Vs2 of a high level, and outputs the monitoring signal MS of a high level by performing a NAND operation on them.

In the case of the sinking in which the driving current OUTPUT changes from a high level to a low level, the sinking current Isi is generated as in FIG. 3. Accordingly, the second sensing unit 38 outputs the second sensing voltage Vs2 of a low level. At this time, since the sourcing current Iso is generated at a low level, the first sensing unit 37 outputs the first sensing voltage Vs1 of a low level. The inverter IV receives the first sensing voltage Vs1 of a low level and converts it into a high level. The NAND gate NA receives the output of the inverter IV which has a high level and the second sensing voltage Vs2 of a low level, and outputs the monitoring signal MS of a high level by performing a NAND operation on them.

In the case where the driving current OUTPUT maintains a high level or maintains a low level, the sourcing current Iso and the sinking current Isi maintain low levels. Namely, the first sensing current Isom of the first sensing unit 37 maintains a level lower than the first reference current IVBN, and the second sensing current Isim of the second sensing unit 38 maintains a level lower than the second reference current IVBP. Therefore, the first sensing unit 37 outputs the first sensing voltage Vs1 of a low level, and the second sensing unit 38 outputs the second sensing voltage Vs2 of a high level. The inverter IV receives the first sensing voltage Vs1 of a low level and converts it into a high level. The NAND gate NA receives the output of the inverter IV which has a high level and the second sensing voltage Vs2 of a high level, and outputs the monitoring signal MS of a low level by performing a NAND operation on them.

Values of the first sensing voltage Vs1, the second sensing voltage Vs2, the output of the inverter IV and the monitoring signal MS of the NAND gate NA corresponding to the respective cases described above may be summarized as in Table 1 below.

TABLE 1

| Driving current change | Vs1 | Output of IV Vs2 | MS |
|---|---|---|---|
| Sourcing | High | Low<br>High | High |
| Sinking | Low | High<br>Low | High |
| Maintaining | Low | High<br>High | Low |

That is to say, in the case where a level of the driving current OUTPUT changes, the monitoring signal MS is outputted to have a high value to define the first period P1. In the case where the driving current OUTPUT maintains a high or low level and thus the sourcing current Iso and the sinking current Isi are maintained at low levels, the monitoring signal MS is outputted to have a low value to define the second period P2. In other words, in the embodiment of the disclosure described above, when a change in a driving current occurs to drive a panel, the first period P1 is sensed by increases in a sinking current and a sourcing current, and the driving current OUTPUT for driving the panel is outputted using a relatively high first bias current during the first period P1. In the embodiment of the disclosure, by using, in this way, a high bias current during a period in which a change in a driving current occurs, the slew rate of the driving current may be improved.

In addition, in the embodiment of the disclosure described above, the second period P2, in which the sourcing current and the sinking current are maintained at low levels after the driving current is changed, is sensed, and the driving current OUTPUT for driving the panel is outputted using a relatively low second bias current during the second period P2.

As is apparent from the above description, according to the embodiments of the disclosure, by using a high bias current during a period in which a change in a driving current occurs and using a bias current having a low level during the other period, a total current consumption amount required to supply the driving current may be reduced.

Further, according to the embodiments of the disclosure, by monitoring, in real time, the current flow of an output terminal of an output buffer for each channel and providing a high bias current to the output buffer during a period in which the driving current is changed, it is possible to supply the driving current with an improved slew rate. Therefore, an advantage is provided in that a total current consumption amount of a display driving apparatus may be reduced.

What is claimed is:

1. A display driving apparatus comprising:

a first bias circuit configured to provide a first bias current;

a second bias circuit configured to provide a second bias current;

a selection circuit configured to receive a monitoring signal having a value that distinguishes a first period in which a sourcing current and a sinking current for output of a driving current are generated and a second period following the first period, to select and output, by the monitoring signal, the first bias current as a bias current during the first period or the second bias current as the bias current during the second period; and an output buffer configured to drive a first input current or a second input current by the bias current, output the driving current for driving a panel, in correspondence to the first input current or the second input current, and provide the monitoring signal having the value that distinguishes the first period and the second period by monitoring the sourcing current by sourcing of the driving current and the sinking current by sinking of the driving current, wherein the first bias current has a level higher than the second bias current.

2. The display driving apparatus according to claim 1, wherein the output buffer monitors the sourcing and the sinking for output of the driving current, and provides the monitoring signal having the value that distinguishes the first period in which the sourcing current and the sinking current for output of the driving current are generated and the second period following the first period, and the selection circuit selects, by the monitoring signal, to output the first bias current or the second bias current as the bias current.

3. The display driving apparatus according to claim 2, wherein the output buffer compares the sourcing current with a first reference current by a preset sourcing reference voltage, compares the sinking current with a second reference current by a preset sinking reference voltage, and provides the monitoring signal distinguishing, as the first period, a period in which the sourcing current is higher than the first reference current or the sinking current is higher than the second reference current.

4. The display driving apparatus according to claim 2, wherein the output buffer comprises:

an output circuit configured to drive the first input current and the second input current by the bias current, and output the driving current by alternately performing the sourcing by a first constant voltage and the sinking by a second constant voltage in correspondence to the first input current and the second input current; and a monitoring circuit configured to provide the monitoring signal having the value that distinguishes the first period and the second period, by monitoring the sourcing current by the sourcing and the sinking current by the sinking.

5. The display driving apparatus according to claim 4, wherein the monitoring circuit comprises:

a first sensing unit configured to compare the sourcing current and the first reference current by the preset sourcing reference voltage, and output a first sensing voltage by determining a period in which the sourcing current is higher than the first reference current;

a second sensing unit configured to compare the sinking current and the second reference current by the preset sinking reference voltage, and output a second sensing voltage by determining a period in which the sinking current is higher than the second reference current; and a monitoring output unit configured to output the monitoring signal which distinguishes the first period and the second period, by comparing the first sensing voltage and the second sensing voltage.

6. The display driving apparatus according to claim 5, wherein the first sensing unit is configured to output the first sensing voltage corresponding to a difference between a first sensing current, obtained by sensing the sourcing current in a current mirror type, and the first reference current, and the second sensing unit is configured to output the second sensing voltage corresponding to a difference between a second sensing current, obtained by sensing the sinking current in a current mirror type, and the second reference current.

7. The display driving apparatus according to claim 5, wherein the monitoring output unit combines the first sensing voltage and the second sensing voltage, and, as a result of combination, provides the monitoring signal corresponding to the first period in the case where the sourcing current is higher than the first reference current or the sinking current is higher than the second reference current, and provides the monitoring signal corresponding to the second period in the case where the sourcing current is equal to or lower than the first reference current and the sinking current is equal to or lower than the second reference current.

8. The display driving apparatus according to claim 1, wherein the first bias circuit receives a high bias current option, and provides the first bias current which is positive, corresponding to the high bias current option, and the second bias circuit receives a low bias current option, and provides the second bias current which is positive, corresponding to the low bias current option.

9. A display driving apparatus comprising:

a bias current source configured to provide a first bias current and a second bias current, the first bias current being higher than the second bias current;

a selection circuit configured to receive the first bias current and the second bias current, and, by a monitoring signal, select and output the first bias current as a bias current during a first period or select and output the second bias current as the bias current during a second period;

an output circuit configured to drive a first input current or a second input current by the bias current, and output a driving current for driving a panel, in correspondence to the first input current or the second input current; and a monitoring circuit configured to monitor a sourcing current by sourcing of the driving current and a sinking current by sinking of the driving current, and provide a monitoring signal having a value that distinguishes the first period in which a change in the driving current occurs and the second period from after the first period to until a next change in the driving current occurs.

10. The display driving apparatus according to claim 9, wherein the monitoring circuit monitors the sourcing and the sinking for output of the driving current, and provides the monitoring signal having the value that distinguishes the first period in which a sourcing current and a sinking current for output of the driving current are generated and the second period following the first period.

11. The display driving apparatus according to claim 10, wherein the monitoring circuit compares the sourcing current with a first reference current by a preset sourcing reference voltage, compares the sinking current with a second reference current by a preset sinking reference voltage, and provides the monitoring signal distinguishing, as the first period, a period in which the sourcing current is higher than the first reference current or the sinking current is higher than the second reference current.

12. The display driving apparatus according to claim 10, wherein the monitoring circuit comprises:

a first sensing unit configured to compare the sourcing current and the first reference current by the preset sourcing reference voltage, and output a first sensing voltage by determining a period in which the sourcing current is higher than the first reference current;

a second sensing unit configured to compare the sinking current and the second reference current by the preset sinking reference voltage, and output a second sensing voltage by determining a period in which the sinking current is higher than the second reference current; and a monitoring output unit configured to output the monitoring signal which distinguishes the first period and the second period, by comparing the first sensing voltage and the second sensing voltage.

13. The display driving apparatus according to claim 12, wherein the first sensing unit is configured to output the first sensing voltage corresponding to a difference between a first sensing current, obtained by sensing the sourcing current in a current mirror type, and the first reference current, and the second sensing unit is configured to output the second sensing voltage corresponding to a difference between a second sensing current, obtained by sensing the sinking current in a current mirror type, and the second reference current.

14. The display driving apparatus according to claim 12, wherein the monitoring output unit combines the first sensing voltage and the second sensing voltage, and, as a result of combination, provides the monitoring signal corresponding to the first period in the case where the sourcing current is higher than the first reference current or the sinking current is higher than the second reference current, and provides the monitoring signal corresponding to the second period in the case where the sourcing current is equal to or lower than the first reference current and the sinking current is equal to or lower than the second reference current.

* * * * *